United States Patent [19]

Chaudhuri

[11] 4,349,383

[45] Sep. 14, 1982

[54] METHOD FOR THE PYROMETALLURGICAL PRODUCTION OF COPPER

[75] Inventor: Kiranendu B. Chaudhuri, Troisdorf, Fed. Rep. of Germany

[73] Assignee: Klöckner-Humboldt-Deutz AG, Fed. Rep. of Germany

[21] Appl. No.: 193,021

[22] Filed: Oct. 2, 1980

[30] Foreign Application Priority Data

Oct. 11, 1979 [DE] Fed. Rep. of Germany ..... 2941225

[51] Int. Cl.[3] ..... C22B 15/04

[52] U.S. Cl. ..... 75/73; 75/24

[58] Field of Search ..... 75/24, 72–75, 75/92

[56] References Cited

U.S. PATENT DOCUMENTS 3,984,235 10/1976 Petersson et al. ..... 75/73
4,127,408 11/1978 Weigel et al. ..... 75/76
4,204,861 5/1980 Petersson et al. ..... 75/73
4,247,087 1/1981 Suprunov ..... 75/74

*Primary Examiner*—M. J. Andrews
*Attorney, Agent, or Firm*—Hill, Van Santen, Steadman, Chiara & Simpson

[57] ABSTRACT

The present invention relates to a method and apparatus for the pyrometallurgical production of copper, from copper bearing sources such as sulfidic ores and/or concentrates. The copper bearing source is smelted into matte and a primary slag in a smelting process, and the matte is converted into blister copper and converter slag in a converter. The smelting is carried out under conditions of high oxygen potential to produce a matte and a primary slag both having relatively high copper contents. The primary slag and the converter slag are withdrawn and preferably mixed together, followed by reduction of both slags by means of gaseous reducing agents to produce additional amounts of copper and to render the slags virtually copper free.

1 Claim, 2 Drawing Figures

METHOD FOR THE PYROMETALLURGICAL PRODUCTION OF COPPER

BACKGROUND OF THE INVENTION

1. Field of the Invention

This invention is in the field of copper recovery by means of a combination of smelting to produce a copper matte and a primary slag, converting the matte into blister copper in a converter which produces a converter slag, and then treating both slags which have relatively high copper contents under reducing conditions to recover additional amounts of copper.

2. Description of the Prior Art

Conventional means for the pyrometallurgical production of copper from sulfidic ores and/or concentrates result in the production of a copper matte and a primary slag by means of a smelting process with suitable additives under approximately neutral or slightly reducing conditions. The matte typically has copper contents on the order of 50% or less, and the primary slag has a copper content usually under 1%. The primary slag is generally discarded, particularly when it is not economical to recover the copper contained therein.

For every metric ton of copper generated, an average of two to three tons of primary slag is produced, and the copper losses per ton of copper produced generally lie in the range of about 10 to 25 kilograms. At a copper price of, for example, $2.00 per kilogram, a possible loss of 25 kilograms per ton represents a cost of $50.00, which is a not inconsiderable sum adding to production costs.

There is approximately a constant relationship between the copper content in the matte and the copper content in the primary slag when using conventional melting methods. According to the publication "Extractive Metallurgy of Copper" by Biswas (Pergamon Press), the copper contents in the two phases correspond to the equation:

$$\frac{\%\ \text{Cu (in the slag)}}{\%\ \text{Cu (in the matte)}} = 0.013$$

According to the same publication, on page 209, FIG. 10.3, the copper content in the primary slag increases progressively with higher copper contents in the matte and can produce copper contents between 4 and 6% in the primary slag depending on the composition of the initial substances as well as the manner in which the process is carried out. It is possible under these circumstances to produce a matte which is very high in copper, for example, about 80% copper, but for reasons of economics, such a manner of carrying out the process has hitherto been avoided insofar as possible.

In the conversion of the matte into blister copper, the copper content in the converter slag generally reaches magnitudes on the order of up to 15%. It is a matter both of oxidic copper in solution in the slag as well as inclusions of copper matte and inclusions of metallic copper, produced both by the high oxidation potential as well as the violent bath motion occurring during the conversion process.

The prior art used various means for regaining the copper from the converter slag. For example, the copper could be settled in a reducing atmosphere in a settling furnace, generally an electric furnace, with a settling time of a few hours in order to produce a low copper final slag having a copper content about 0.5%. Another method provided for recirculation of the converter slag into the smelting reactor in order to provide the slag with an opportunity to produce sedimentary precipitation of the copper content. Another method consisted in grinding the granulated slag and floating it on the copper. All these methods were relatively complicated and quite expensive.

It is accordingly understandable that in the prior art, an attempt was made to keep the copper content of the primary slag as low as possible in order to reduce the costs due to the loss of copper, thus lowering the production costs. The relatively low copper content resulting in the primary slag and matte corresponding to the equilibrium of the copper contents in the primary slag and matte, being on the order of 30 to 40%, requires a more severe conversion utilizing greater converter volumes, more consumption of reaction agent, larger amounts of converter slags, and correspondingly higher costs.

In view of the relationship of the copper contents of matte and primary slag, and the relationship between smelt, conversion, and slag cleaning costs, the prior art previously only had the choice of shifting the emphasis of the related process steps toward one or the other to a greater or lesser degree depending upon the starting materials, as well as the available apparatus and sources of energy. Such technical compromises, however, were not always satisfactory.

SUMMARY OF THE INVENTION

The present invention provides a method in which economical copper production is rendered possible with the greatest possible reduction of copper losses. The result is achieved by means of a simplification of the process sequence, providing for continuous processing as well as improving the heat economy particularly in the smelting process. By means of the present invention, it is possible to modernize and increase the capacity of conventional outmoded systems with relatively low capital costs.

The improvements of the present invention are provided by carrying out the smelting process with a high oxygen potential so that a matte as well as a slag are produced which have relatively high copper contents. The primary slag and converter slag are withdrawn from the smelting and converting process respectively, and the copper contained therein is recovered by means of reduction with gaseous or suspended powder reduction agents.

The process of the present invention produces a very high grade matte which can be converted into blister copper under favorable cost conditions. With an increased copper content in the matte, the amount of converter slag is reduced and thereby a lower converter volume and lower use of reaction agents such as oxygen are required. The amount of exhaust gas is likewise reduced whereby the relative content of sulfur in the exhaust gases is increased. The economics for exploitation of the exhaust gas, particularly for the production of sulfuric acid, are thereby improved. The increased availability of oxygen in the smelting process in the presence of sulfidic compounds enables an increased vapor pressure to be achieved particularly of the volatile secondary elements which are carried away with the exhaust gas.

In a preferred embodiment of the invention, the primary and converter slags are combined into a mixture, and copper contained in this mixture is recovered. This produces the advantage that the copper losses in the final slag are reduced overall without the costs for slag cleaning reaching prohibitive proportions.

In a preferred embodiment of the invention, the matte produced under the high oxygen potential conditions has a copper content of at least 50% and is preferably 60 to 80% by weight.

One of the advantages of the method is that conventional and/or outmoded systems can be considerably increased in terms of productivity without large capital costs since the existing furnace and converter capacities can be charged to capacity with the increasing copper content in the matte.

In the practice of the present improved process, the copper content in the primary slag amounts to at least 1% and is preferably between 3 and 7% by weight. With an increased copper content in the primary slag, there is the advantage that the amount of slag is notably decreased in comparison to the amount of copper produced with an increasing copper content in the primary slag.

The smelting process may be executed by means of the flame smelting method whereby a suspension of the finegrained copper bearing source is maintained in a hot flame. Alternatively, the smelting process may be carried out by means of a cyclone smelting method. The flame smelting method has the advantage that it is relatively inexpensive and quite efficient. Since the smelting process makes efficient use of high oxygen conditions, it can be carried out with an extremely hot flame.

The aftertreatment of the slags is preferably carried out by a reducing reaction wherein reducing gases are blown in a substantially perpendicular direction onto the surface of the slag through at least one accelerating nozzle with large mass velocities to produce a concentrated, high energy gas stream which creates a layer of slag which is approximately of toroidal shape. This slag cleansing method is particularly advantageous in that it is suitable for continuous production. Consequently, high degrees of purity of the final slag are achieved by means of controlled bath motion and mass transfers because the precipitatable, non-volatile components of the copper may settle into a heavier, fluid phase and the volatile secondary metals are caused to volatilize with correspondingly high vapor pressures as a result of the high temperatures generated in the high energy gas streams. The processing of slags therefore can be conveniently carried out in a continuous manner through a reduction zone, to produce slags in which the copper content amounts to less than 0.5%.

The apparatus of the present invention includes a smelting zone, and a liquefying means within the zone into which fuel and oxygen are introduced. The copper bearing solids are introduced into the smelting zone and thereby into the liquefying means. A settling furnace is located beneath the liquefying means to receive molten materials as they are being produced. Means are provided in the settling furnace for separately withdrawing a heavier copper matte phase and a lighter liquid primary slag phase from the settling zone. The copper matte is passed to a converter where treating agents are introduced to convert the copper matte into blister copper, converter slag, and exhaust gases. An aftertreatment reactor is provided into which the primary slag and the converter slag are introduced. A reducing agent is introduced into the reactor, and the resulting substantially copper-free slag and the molten copper are separately recovered.

The liquefying means may include a burner into which the source solids are introduced in gaseous suspension, or it may consist of a cyclone smelter.

The aftertreatment reactor may include lances which are positioned substantially perpendicular to the surface of the melted slags to blow the reducing agent thereon.

More specifically, the aftertreatment reactor may consist of a housing having a settling hearth therein, with wall means separating the gases in the liquefying means from gases in the settling hearth. Means are also provided for withdrawing matte from the settling hearth and passing it to the converter. Means are also provided for introducing converter slag into the housing above the level at which the matte is withdrawn.

BRIEF DESCRIPTION OF THE DRAWINGS

A further description of the present invention will be made in connection with the attached sheets of drawings in which.

DESCRIPTION OF THE PREFERRED EMBODIMENTS

Figure 1:
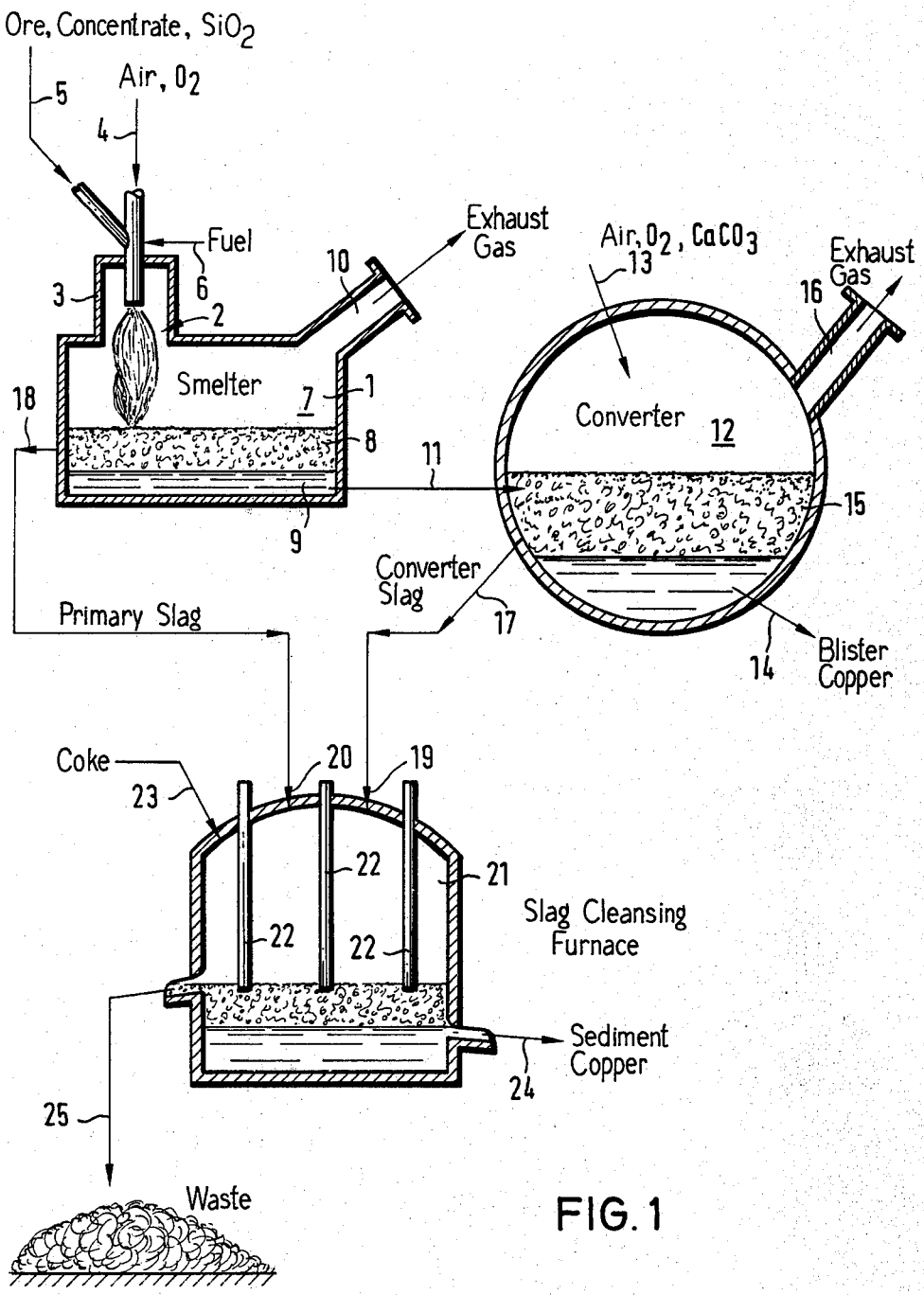
FIG. 1 represents a schematic diagram of a process and apparatus according to the present invention, including a smelting furnace, converter, and aftertreatment reactor.

In FIG. 1, there is shown a smelting furnace 1 which is equipped with a smelting zone 2 wherein air and/or oxygen is introduced by means of a line 4. The ore and/or concentrate as well as slag forming additives such as silica are introduced by means of a line 5. If needed, fuel may be introduced by means of a line 6 into a smelting stack 3 utilizing the flame smelting method. In the smelter chamber 7, the smelt forms two molten phases of different specific gravity, consisting of a lighter phase of primary slag 8 and a heavier phase of copper matte 9. The smelter is operated under conditions of high oxygen potential, i.e., using technically pure oxygen or oxygen-enriched air containing more than 21% by volume oxygen. The smelting temperature may be up to 1800° C. The exhaust gas escapes through a discharge 10. The matte is continuously or intermittently delivered by means of a line 11 to a converter 12 and is separated in the converter into two liquid phases of different density by means of reaction with oxygen or an oxygen-containing gas such as air and the addition of limestone, all of which are shown being introduced by means of a line 13. The products of the converter 12 are a layer of blister copper 14 and a layer of converter slag 15. Exhaust gas escapes through a discharge 16. The converter slag is withdrawn from the converter 12 as indicated by the line 17 and primary slag is withdrawn from the smelting furnace 7 through a line 18. Both slags are delivered to an aftertreatment slag cleaning furnace 21 through inlet means which are represented by the arrows 19 and 20. In the form of the invention shown, the slag cleaning furnace is an electric furnace in which the mixture of primary slag and converter slag is held at a constant temperature by means of electrodes 22 during the duration of the settling process by means of electrical heating. In order to generate a reducing atmosphere, powdered coke is delivered to the surface of the bath as indicated by an inlet line 23. The sediment copper deposits in the slag cleaning furnace 21 and is withdrawn through a line 24. The final slag exhibits a final copper content of about 0.4% and is discarded into a waste as shown schematically by means of a line 25.

Figure 2:
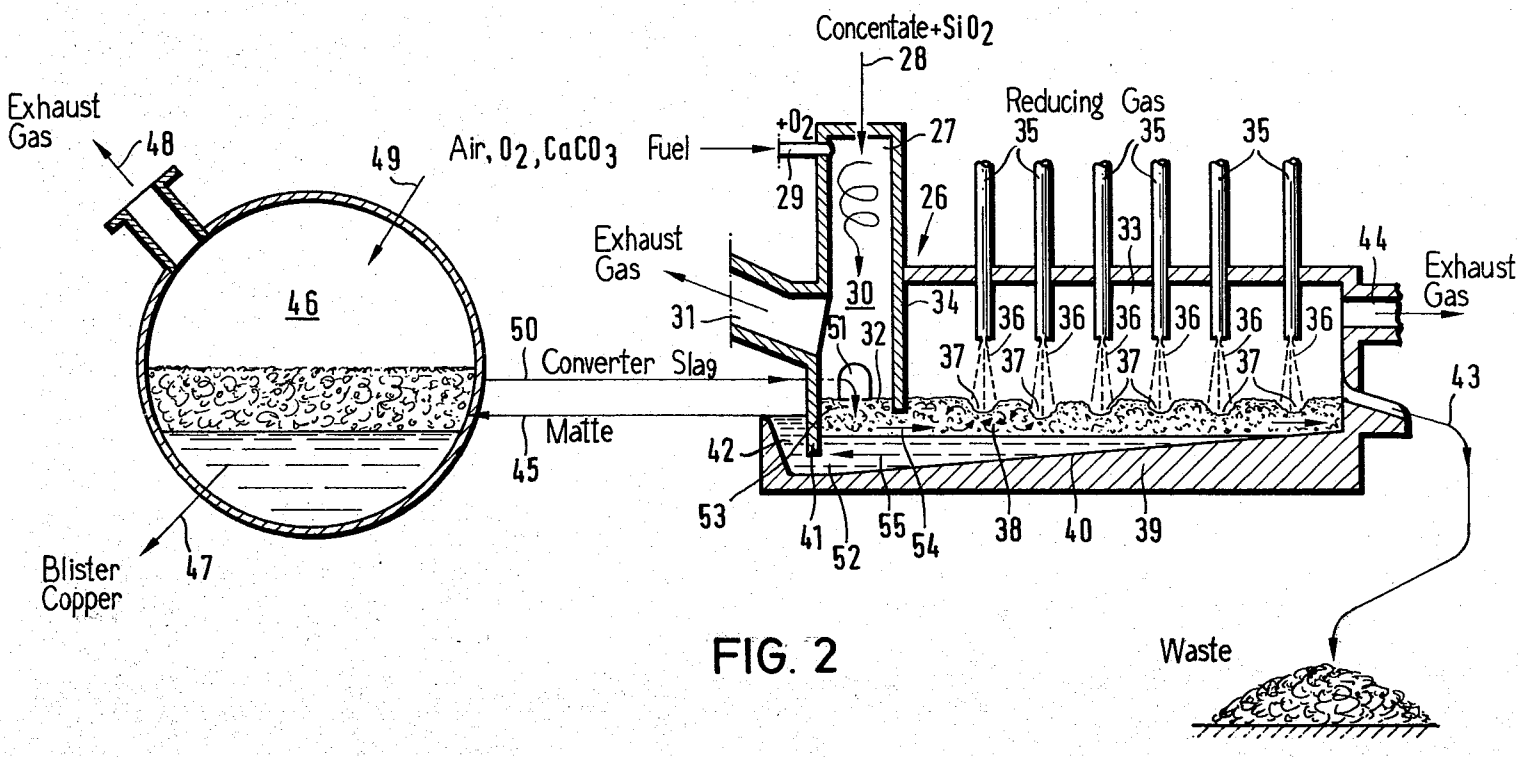
FIG. 2 is an embodiment according to the present invention which includes an aftertreatment reactor and smelting furnace in a common housing, as well as a converter connected thereto.

The arrangement shown in FIG. 2 includes a combination of smelting furnace, settling furnace, and slag cleansing furnace housed in a common furnace housing 26. A smelting zone 27 consists of a smelting cyclone and is provided with a concentric intake 28 for receiving the concentrate and silica, as well as with a burner 29 for supplying fuel and an oxygen-containing gas. The smelting is accomplished in the cyclone 27 in a furnace portion 30 from which exhaust gas is withdrawn through an outlet 31. The smelt collects in an area 32 beneath the smelting cyclone. A furnace zone 30 of the smelting furnace is hermetically separated from a gas space 33 of the aftertreatment reaction zone by means of a wall 34. The aftertreatment reactor communicates with respect to the liquid phases by means of a common trough 39 extending from the aftertreatment to the smelting zone. A plurality of top-blowing lances 35 are provided in the aftertreatment zone through which reduction gases are blown under the surface of the smelt with a high mass velocity. The lances 35 contain nozzles 36 at their ends, the nozzles being preferably designed as venturi tubes, and blow a controlled gas stream under the bath surface with a high velocity in such a manner that gases produced blow impressions 37 in the molten slag. The smelt is thus placed into violent toroidal bath motion as indicated by means of the arrows 38. The trough 39 of the reactor 33 is equipped with an inclined bottom portion 40 extending at an angle with respect to the horizontal. A siphon-like overflow 42 serves to withdraw the heavier matte phase precipitated from the smelt, and includes a weir 41 projecting from above into the melt. A discharge 43 for the substantially copper-free final slag is situated on the opposite side of the trough 39 at a higher level, and a discharge 44 for the exhaust gas is positioned in the gas space above the slag. The matte discharged at the overflow portion 42 is introduced into the converter by means of a line 45. In the converter 46, the matte is converted into blister copper and converter slag by means of oxygen or an oxygen-containing gas and limestone, in accordance with the usual procedure. The blister copper is continuously or intermittently drawn off through a discharge line 47. The exhaust gas is passed out through a discharge outlet 48. Air, oxygen, and limestone are introduced by means of a line 49. The resulting converter slag is withdrawn from the converter with any desired transport means which is illustrated schematically by means of a line 50 and is introduced into the smelting zone 30 by means of a closable aperture 51.

The converter slag mixes with the smelt to form a smelt mixture from which the heavier, copper-containing phase 52 and a lighter slag phase 53 separate. The slag phase flows in the direction of the arrow 54 under the partition 34 into the aftertreatment reactor 33 and is there cleansed of its copper content by means of the treatment with reduction gas so that the final slag is cleansed to below a 0.5% copper content and is withdrawn through a line 43. The metal phase, essentially matte, lying below the slag phase moves in a slow pattern toward the discharge location 42 in the direction of the arrow 55, thereby providing a countercurrent flow with respect to the lighter slag phase.

It should be evident that various modifications can be made to the described embodiments without departing from the scope of the present invention.

I claim as my invention:

1. In a method for the pyrometallurgical production of copper from a copper bearing source in which said source is smelted into matte and primary slag in a smelting process and the matte is converted into blister copper and converter slag in a converter, the improvement which comprises:

carrying out the smelting under conditions of high oxygen potential to produce a matte having a copper content of from 60 to 80% and a primary slag having a copper content of from 3 to 7%, combining said primary slag and said converter slag, reducing the combined slags in a reduction zone by blowing reducing gases substantially perpendicular to the molten slags under sufficient gas velocity to generate a rotating, substantially toroidal layer, and continuing the reducing treatment until the reduced slags have a copper content of less than 0.5%.

* * * * *